US005794602A

United States Patent [19]

Kimura

[11] Patent Number: 5,794,602

[45] Date of Patent: Aug. 18, 1998

[54] CRANKCASE VENTILATING SYSTEM

[75] Inventor: Sakayuki Kimura, Hamamatsu, Japan

[73] Assignee: Sanshin Kogyo Kabushiki Kaisha, Shizuoka, Japan

[21] Appl. No.: 697,907

[22] Filed: Aug. 30, 1996

[30] Foreign Application Priority Data

Aug. 30, 1995 [JP] Japan ..... 7-221620

[51] Int. Cl.[6] ..... B63H 21/26

[52] U.S. Cl. ..... 123/572

[58] Field of Search ..... 123/572, 573, 123/574, 41.84

[56] References Cited

U.S. PATENT DOCUMENTS

| | | | |
|---|---|---|---|
| 4,501,234 | 2/1985 | Toki et al. | 123/572 |
| 4,569,323 | 2/1986 | Okumura . | |
| 4,597,372 | 7/1986 | Furukawa . | |
| 4,667,647 | 5/1987 | Ohtaka et al. . | |
| 5,036,822 | 8/1991 | Kojima . | |
| 5,067,449 | 11/1991 | Bonde | 123/572 |
| 5,429,101 | 7/1995 | Uebelhoer et al. | 123/572 |
| 5,474,035 | 12/1995 | Ming et al. . | |
| 5,501,202 | 3/1996 | Watanabe . | |

FOREIGN PATENT DOCUMENTS

| | | |
|---|---|---|
| 3-119562 | 3/1991 | Japan . |
| 3-32998 | 7/1991 | Japan . |

*Primary Examiner*—Marguerite McMahon

*Attorney, Agent, or Firm*—Knobbe, Martens, Olson & Bear, LLP

[57] ABSTRACT

A ventilation system is provided to vent blow-by gases from a crankcase of an internal combustion engine and to deliver the blow-by gases back to the combustion chambers of the engine for eventual expulsion through the engine exhaust system. The ventilation system includes a lubricant separator located on the side of a cylinder block of the engine. The lubricant separator desirably lies beneath a charge former of the engine at a location which does not increase the overall girth of the engine. The ventilation system also desirably includes a secondary lubricant separator integrated into an intake air device which communicates with the charge former. Both the first and second lubricant separators deliver lubricant, which is separated from the vented blow-by gases back to a reservoir of a lubrication system. The blow-by gases that are vented through the first and second lubricant separators are delivered to the charge former through the intake air device.

28 Claims, 8 Drawing Sheets

CRANKCASE VENTILATING SYSTEM

BACKGROUND OF THE INVENTION

1. Field of the Invention

The present invention relates in general to an internal combustion engine, and more particularly to a ventilation system for such an engine.

2. Description of Related Art

Typical internal combustion engines often circulate air within the lubrication system of the engine to enhance lubrication and to extend the life of the lubricant. For this purpose, many internal combustion engines allow some combustion gases, which blow by the piston rings into the crankcase ("blow-by gases"), to circulate within the lubrication system.

Internal combustion engines typically employ a ventilation system to vent the blow-by gas from the lubrication system in order to produce an airflow through the crankcase. Such ventilation systems are common in both outboard motors and in inboard/outboard motors.

Many ventilation systems exhaust the blow-by gas from the lubrication system at the cylinder head and introduce the removed blow-by gas back into the induction system for eventual expulsion through a conventional exhaust system. Though effective in venting blow-by gas from a crankcase, prior ventilation systems commonly are too large and protrusive, and are overly complicated.

Prior ventilation system often include a breather chamber which is formed either on the exterior of a cylinder head cover or within the head cover. The cover is commonly disposed at one end of the engine. In either case, the breather chamber causes the cylinder head cover to protrude further from the cylinder head of the engine, which consequently enlarges the overall girth of the engine. This problem is exacerbated where larger breather chambers are employed for improved lubricant separation. Consequently, the girth of the engine and the protecting cowling must be increased, thereby increasing drag on the outboard motor.

In some prior designs, the breather chamber of the ventilation system is mounted on top of the cylinder block; however, in this position, the size of the breather chamber is limited. A timing belt, as well as other engine components which are commonly located on the upper end of the cylinder block of the outboard motor, do not allow for an enlarged breather chamber. For instance, an enlarged breather chamber would interfere with the timing belt and pulleys in this type of engine layout.

In addition, the overly complicated nature of the prior breather chambers increases the number of engine components. As a result, material and labor costs associated with engine production escalate.

SUMMARY OF THE INVENTION

A need therefore exists for a simply structured crankcase ventilation system which reduces the overall size of the engine while efficiently separating blow-by gases from engine lubricant.

One aspect of the present invention thus involves an internal combustion engine comprising a crankcase formed between a cylinder block and a crankcase member. A lubricant system circulates lubricant through at least the crankcase. A ventilation system communicates with the lubricant system and includes a lubricant separator. The lubricant separator is disposed on the side of cylinder block in a position which reduces the overall girth of the engine.

In accordance with another aspect of the present invention, an internal combustion engine comprises at least one variable-volume compression chamber which communicates with at least one intake passage. An induction system includes an air intake device that supplies air to a charge former. The charge former delivers a fuel/air charge to the intake passage. A lubricant system circulates lubricant through the engine, together with a flow of blow-by gases. A ventilation system includes a first lubricant separator that communicates with the lubricant system so as to vent a portion of the blow-by gases from the lubricant system. A second lubrication separator receives a flow of blow-by gases from the first lubricant separate and communicates with the air intake device. In this manner, at least a portion of the vented blow-by gases are reintroduced into the variable-volume compression chamber through the intake passage.

BRIEF DESCRIPTION OF THE DRAWINGS

These and other features of the invention will now be described with reference to the drawings of a preferred embodiment which is intended to illustrate and not to limit the invention, and in which.

DETAILED DESCRIPTION OF THE PREFERRED EMBODIMENT

Figure 1:
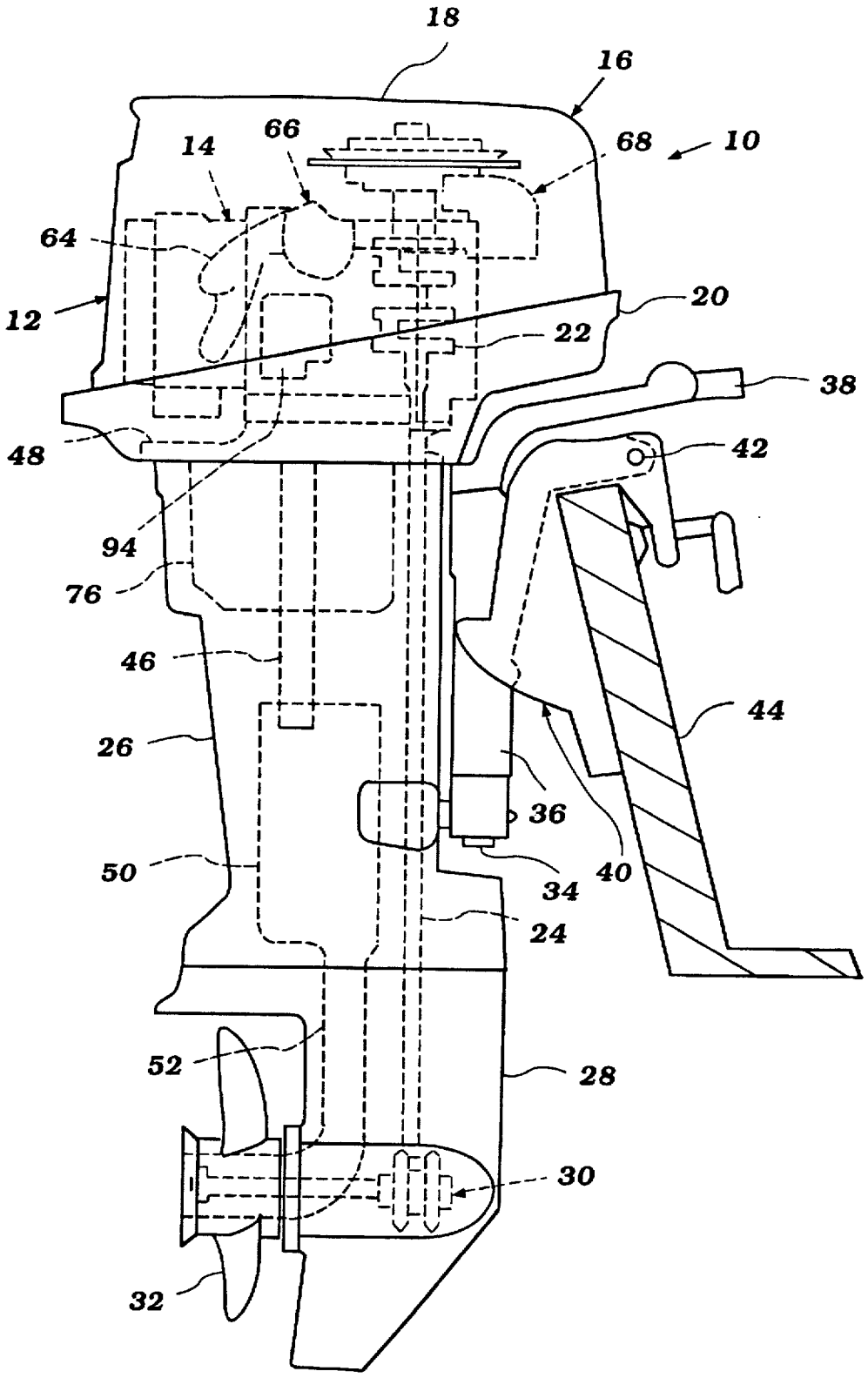
FIG. 1 is a side elevational view of a marine outboard motor which incorporates a crankcase ventilation system which is configured in accordance with the preferred embodiment of the present invention.

The FIG. 1 illustrates an outboard drive 10 which incorporates a crankcase ventilation system configured in accordance with the preferred embodiment of present invention. Because the present crankcase ventilation system has particular utility with an outboard motor, the crankcase ventilation system is described below in connection with outboard motor 10; however, the description of the invention in conjunction with an outboard motor is merely exemplary. Those skilled in the art will readily appreciate that the present crankcase ventilation system can be used with an inboard motor of an inboard/outboard drive, with an inboard motor of a personal watercraft, and with other types of internal combustion engines as well.

The outboard motor 10 has a power head 12 which includes an internal combustion engine 14. A protective cowling assembly 16 surrounds the engine 14. The cowling assembly 16 includes a main cowling portion 18 that is desirably connected to a tray portion 20.

As is typical with outboard motor practice, the engine 14 is supported within the power head 12 so that its output shaft 22 (i.e., crankshaft) rotates about a vertically extending axis. The crankshaft 22 is rotatably coupled to a drive shaft 24 that depends into and is journalled within a drive shaft housing 26. The tray 20 encircles the upper portion of the drive shaft housing 26 as well as the lower portion of the engine 14.

The drive shaft housing 26 extends downwardly from the lower tray 20 and terminates in a lower unit 28. The drive shaft 24 extends into the lower unit 28 to drive a transmission 30 housed within the lower unit 28. The transmission 30 selectively establishes a driving condition of a propulsion device 32, such as, for example, a propeller. In the illustrated embodiment the transmission 30 desirably is a forward/neutral/reverse-type transmission. In this manner, the propulsion device 32 can drive the watercraft in any of these three operating states.

A steering shaft 34 is affixed to the drive shaft housing 26 by upper and lower brackets. The brackets support the steering shaft 34 for steering movement within a swivel bracket 36. Steering movement occurs about a generally vertical steering axis which extends through the steering shaft 34. A steering arm 38 is connected to an upper end of the steering shaft 34 and extends in a forward direction for manual steering of the outboard drive 10, as is known in the art.

The swivel bracket 36 also is pivotally connected to a clamping bracket 40 by a pin 42. The clamping bracket 40, in turn, is configured to attach to a transom 44 of the watercraft. This conventional coupling permits the outboard drive 10 to be pivoted relative to the pin 42 to permit adjustment of the trim position of the outboard drive 10 and for tilt-up of the outboard drive 10.

As seen in FIG. 1, the drive shaft housing 26 and the lower unit 28 also house an exhaust system. The exhaust system communicates with the engine 14 to discharge exhaust gases from the engine 14 to a low pressure region formed directly behind the propeller 32 in a body of water in which the watercraft is operated. In the illustrated embodiment, the exhaust system includes an exhaust pipe 46 which depends from an exhaust guide 48 attached to the lower side of the engine 14. The exhaust pipe 46 extends downwardly to an expansion chamber 50 located within the drive shaft housing 26. An exhaust conduit 52 extends from a lower end of the expansion chamber 50, through the lower unit 28 to a discharge passage formed within the hub of the propeller 32. In this manner, exhaust gases are discharged through the propeller hub into the low pressure region in the water behind the propeller 32.

Figure 2:
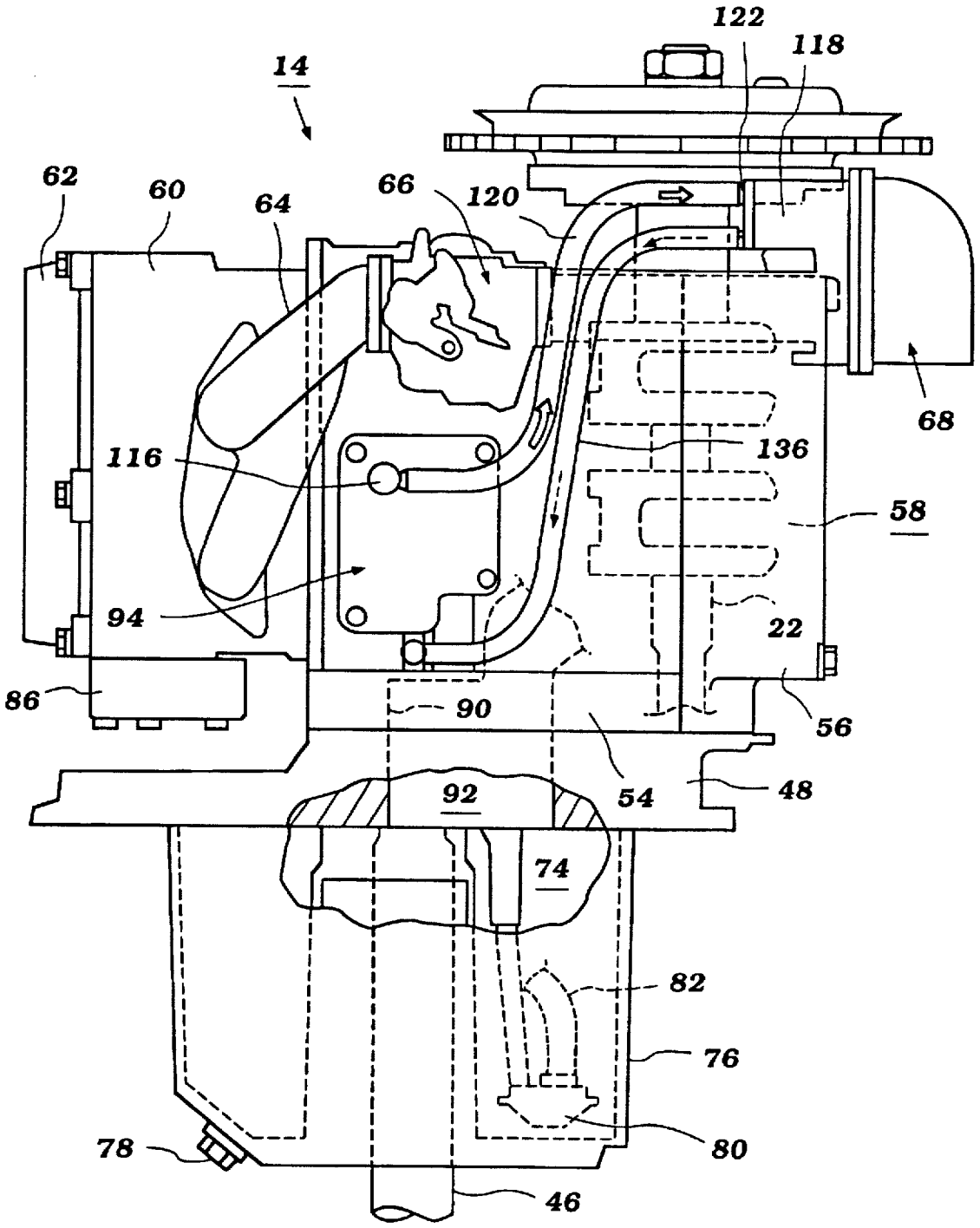
FIG. 2 is an enlarged, side elevational view of the outboard motor of FIG. 1.

With reference to FIG. 2, the engine 24 includes a cylinder block 54 which in the illustrated embodiment defines a pair of horizontally oriented cylinder bores 55. As best understood from FIG. 4, the bores 55 are arranged within the cylinder block 54 such that one lies above the other. Pistons (not shown) reciprocate within the cylinder bores 55, and connecting rods (not shown) link the pistons to the crankshaft 22 such that reciprocal movement of the pistons rotates the crankshaft 22 in a known manner.

A crankcase member 56 is attached to one end of the cylinder block by known means to form a crankcase 58. The crankshaft 22 is suitably journalled for rotation within the crankcase 58.

On an opposite end of the cylinder block 54, a cylinder head assembly 60 is attached. The cylinder head assembly 60 desirably has a conventional construction. The cylinder head assembly 60 includes a plurality of recess (not shown) which correspond in number to the number of cylinders 55 of the cylinder block 54. One of the recesses cooperates with one of the cylinder bores 55 to close the end of the cylinder bore 55. The corresponding recess, cylinder bore 55 and piston define a variable-volume compression chamber, which at minimum volume, defines the combustion chamber. Spark plugs (not shown) are mounted in the cylinder head assembly 60 and are fired by a suitable ignition system (not shown).

The cylinder head assembly 60 also supports and houses a plurality of intake and exhaust valves (not shown) as well as at least one camshaft. The camshaft cooperates with a valve operating mechanism which opens and closes the valves at desired times during the combustion cycle, as known in the art. An external timing belt (not shown) extends between the crankshaft 22 and the camshaft to drive the camshaft in a known manner. A camshaft cover 62, which is attached to the cylinder head 60, encloses the camshaft as well as the intake and exhaust valves within the cylinder head assembly 60.

As seen in FIG. 2, an intake manifold 64 is interposed between a charge former 66 and the cylinder head assembly 60. In the illustrated embodiment, the charge former 66 is a carburetor connected to the intake manifold 64. The present crankshaft ventilation system, however, can be used equally well with other conventional types of charge forming devices, such as, for example, a fuel injector device.

The intake manifold 64 includes a plurality of runners. Each runner communicates with one of the cylinder bores 55 via valve ducts (not shown) in the cylinder head assembly 60. The runners thus place the carburetor 66 in communication with each of the cylinder bores of the cylinder block 54. In this manner, as known in the art, the carburetor supplies a fuel/air charge to the compression chambers of the engine 14.

The induction system of the engine 14 also includes an air intake device 68. The air intake device communicates with the charge former 66 in order to provide intake air to the charge former 66. The specific construction of the intake device 68 is provided below.

Figure 4:
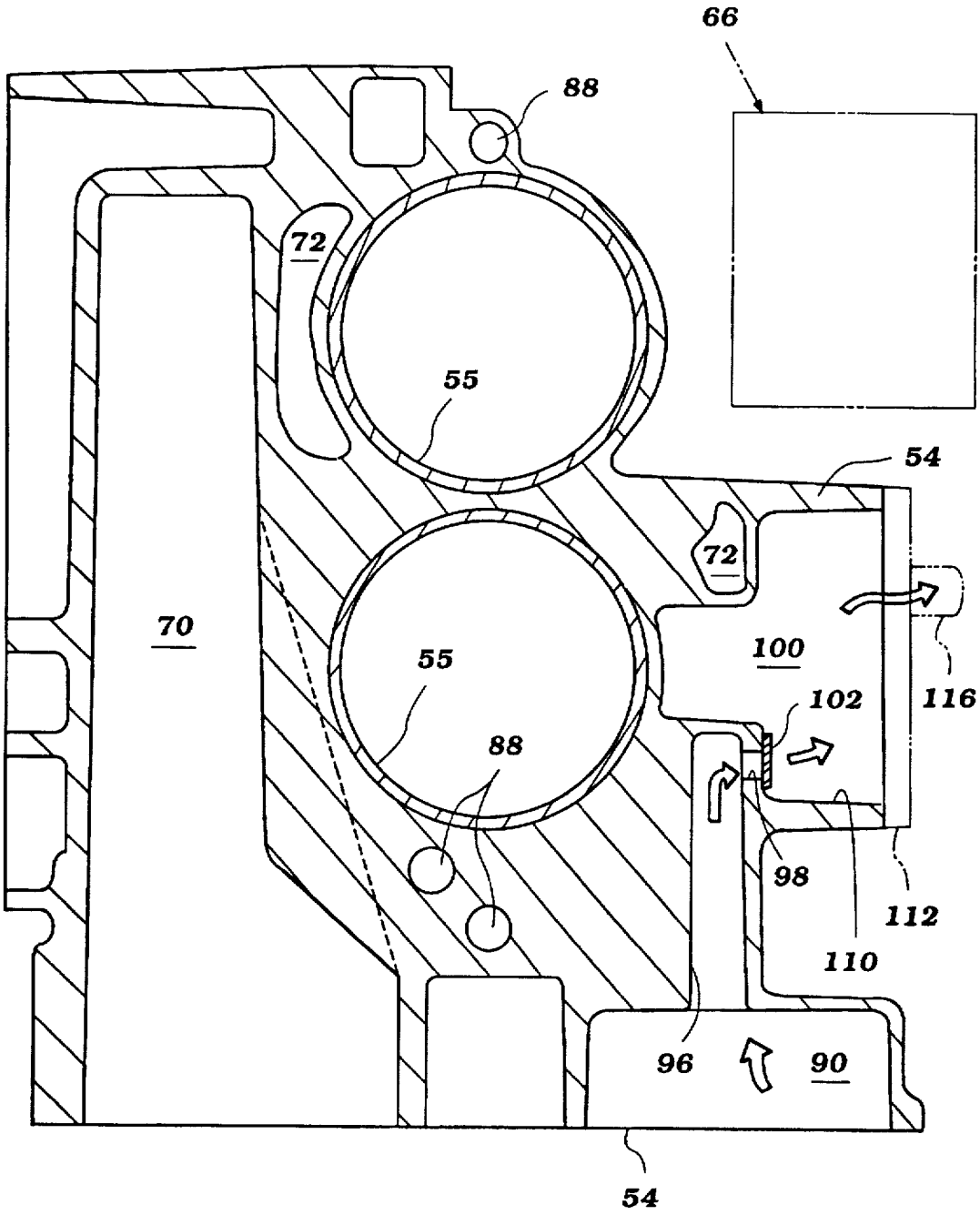
FIG. 4 is a cross-sectional view of the cylinder block of FIG. 3 taken along line 4—4.

As best seen in FIG. 4, the cylinder block 54 defines an exhaust passage 70 which communicates with exhaust valve ducts formed in the cylinder head assembly 60. The exhaust passage 70 also communicates with an exhaust path 92 that extends through the exhaust guide 48. As appreciated from FIG. 2, the exhaust pipe 46 connects to the lower end of the exhaust guide 48 and extends to the expansion chamber 50 formed in the drive shaft housing 26, as described above.

With reference back to FIG. 4, the cylinder block 54 also includes a plurality of water jacket passages 72 that extend through the cylinder block 54. The water jackets 72 form part of a conventional water cooling system which picks up water from the body of water in which the watercraft is operated to cool the engine 14 in a known manner.

The engine 14 also includes a lubrication system which circulates lubricant (e.g., a conventional marine-grade motor oil) between the crankcase 58 and the cylinder head assembly 60. For this purpose, the lubricant system includes a reservoir 74 of lubricant.

In the illustrated embodiment, the reservoir 74 is formed within a pan 76 that is attached to the lower side of the exhaust guide 48. The reservoir 74 has an annular shape which surrounds the exhaust pipe 46. As seen in FIG. 2, the exhaust pipe thus extends through the pan in a downward direction. The pan 76 desirably includes a drain plug 78 to allow the lubricant to be drained from the reservoir 74 in a conventional manner in order to change the lubricant.

As seen in FIG. 2, a strainer 80 is positioned within the reservoir 74. A pickup conduit 82 connects the strainer 80 to a lubricant passage 84 formed within the cylinder block 54. A lubricant pump 86 draws lubricant from the reservoir 74 through the strainer 80 and the pickup conduit 82, and into the lubricant passage 84 which then delivers the lubricant to the lubricant pump 86. The lubricant pump 86 produces a flow of lubricant through the cylinder head assembly 60. The camshaft within the cylinder head assembly 60 drives the lubricant pump 86, which in the illustrated embodiment, is attached to the lower end of the cylinder head assembly 60.

In the illustrated embodiment, as best seen in FIG. 4, a plurality of passages 88 extend through the cylinder block 54 to deliver lubricant from the cylinder head assembly 60 to the crankcase 58. The cylinder block 54 also includes a lubricant return passage 90 through which lubricant is returned to the reservoir 74.

The lubricant return passage 90 communicates with a passageway 92 formed in the exhaust guide 48 that opens into the reservoir 74 at the upper end of the pan 76. In this manner, lubricant is circulated through the cylinder head assembly 60 and crankcase 58 and returned to the reservoir 74 within the pan 76. It should be understood, however, that the lubricant circulation path can alternatively be from the crankcase 58 to the cylinder head and then returned to the reservoir 74.

As the lubricant circulates through the engine 14 in this manner, the lubricant flow within the lubrication system entrains a portion of those gases which blow through combustion rings of the pistons into the crankcase 58 (i.e., blow-by gas). The blow-by gases thus circulate within the lubrication system with lubricant.

As seen in FIG. 2, a lubricant separator 94 of the crankcase ventilation system is disposed on the side of the cylinder block 54 beneath the charge former 66. This location of the lubricant separator 94 does not increase the overall girth of the engine 14, as is the case with the prior locations of the lubricant separator, either on the cylinder head cover or on the upper side of the cylinder block. As a result, the engine 14 has an overall more compact layout than prior engine designs.

Figure 3:
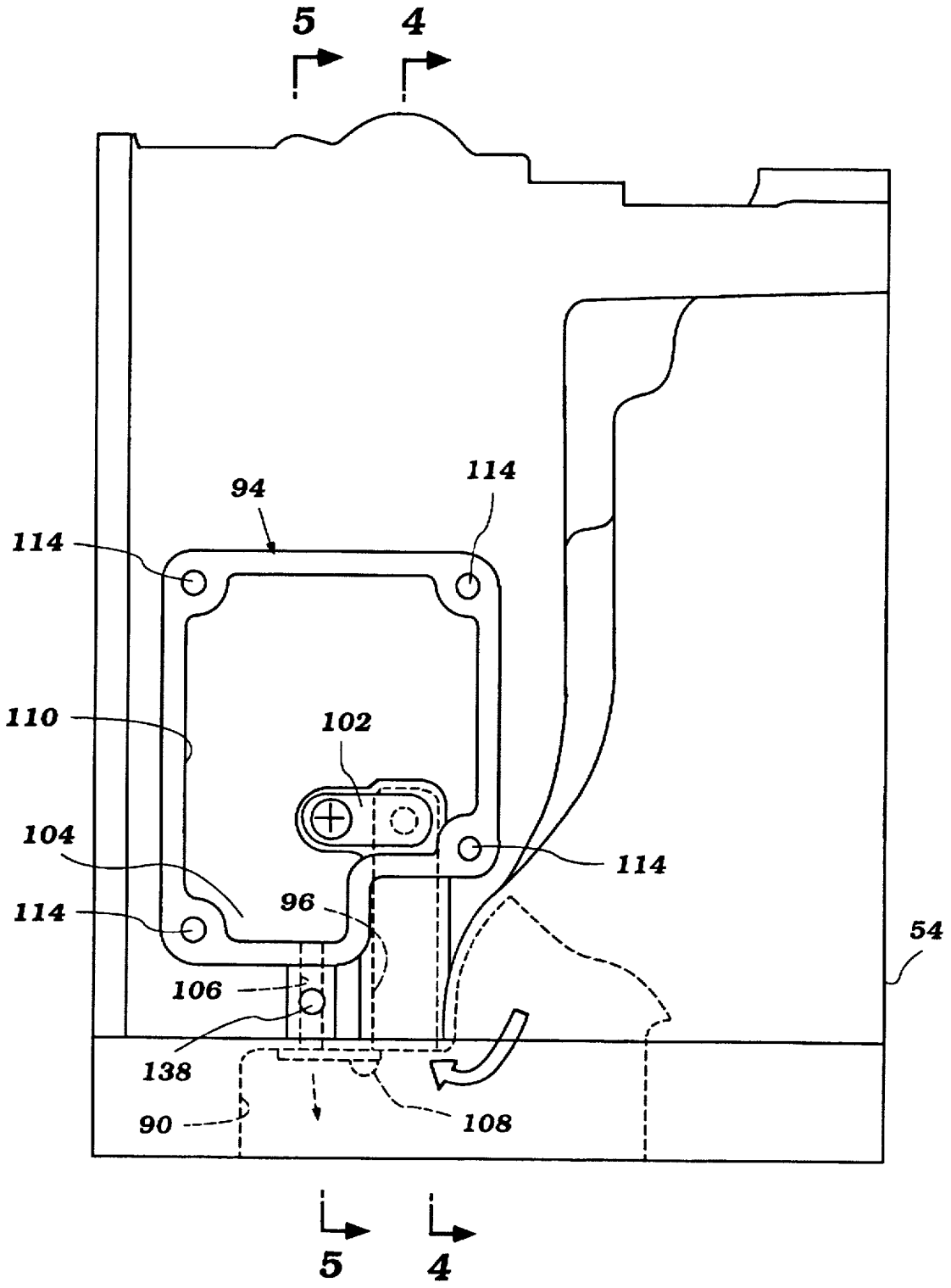
FIG. 3 is an enlarged, side elevational view of a cylinder block of the engine of FIG. 2, illustrating a breather chamber of the ventilation system with a cover plate removed.

With reference to FIG. 3, the lubricant separator 94 communicates with the lubricant return passageway 90 through a first passage 96 formed within the cylinder block 54. In the illustrated embodiment, the first passage 96 extends upwardly in a direction generally parallel to an axis of the crankshaft 22.

As best seen in FIG. 4, the lubricant separator 94 includes a flow restriction or orifice 98 which opens into a breather chamber 100. The breather chamber 100 has a significantly larger volume than the flow volume through the orifice 98 such that an expansion of the gases flowing into the breather chamber 100 occurs which is significant enough to separate lubricant vapor from the gases. That is, as the compressed gases flowing through the orifice 98 rapidly expand in the breather chamber 100, lubricant in a vaporized form tends to fall out of the gases and collect of the bottom of the breather chamber 100. The differential in volumetric size between the orifice 98 and the breather chamber 100 promotes this separation.

A valve 102 operates between the passage 96 and the breather chamber 100 to allow an ingress of blow-by gases into the breather chamber 100, but to prevent an egress of gases from the chamber 100. This assists maintaining a circulation of air within the lubrication system. In the illustrated embodiment, the valve 102 is a check valve that operates between the orifice 98 and the breather chamber 100. The valve 102 is normally biased closed and covers the orifice 98. When sufficient gas pressure builds in the lubricant return passageway 90, the gases force the valve 102 open and flow into the breather chamber 100.

As seen in FIGS. 3 and 4, the orifice 98 is located above the lower side of the breather chamber 100 and opens into the chamber 100 toward an outer wall of the chamber 100. Gases flowing through the orifice 98 thus impinge against the wall and subsequent change flow direction within the breather chamber 100 to further promote the separation of the lubricant vapor from the blow-by gases.

The lower side of the breather chamber 100 forms a well section 104 in which separated lubricant collects. A drain is formed at the bottom of the well section 104 to return the lubricant to the reservoir 74. In the illustrated embodiment, the drain includes a passage 106 that extends downwardly from the well section 104 and opens into the lubricant return passageway 90 within the cylinder block 54 at a point downstream of the passage 96 leading to the orifice 98.

A valve 108 operates between the drain passage 106 and the lubricant return passageway 90 to prevent blow-by gases from flowing through the drain passage 106 and entraining the lubricant already once separated from the blow-by gas steam. The valve 108, however, permits lubricant to flow from the well section 104 of the breather chamber 100, through the drain passage 106, and into the lubricant return passage 90. In the illustrated embodiment, the valve 108 is a check valve that operates between the drain passage 106 and the lubricant return passageway 90. The valve 108 is normally biased closed and covers the drain passage 106. When sufficient lubricant collects in the well section 104, the head of the lubricant force the valve 108 open. The separated lubricant then joins the lubricant flow through the lubricant return passageway 90 and returns to the lubricant reservoir 74 in the pan 76 below the exhaust guide 48.

Figure 6:
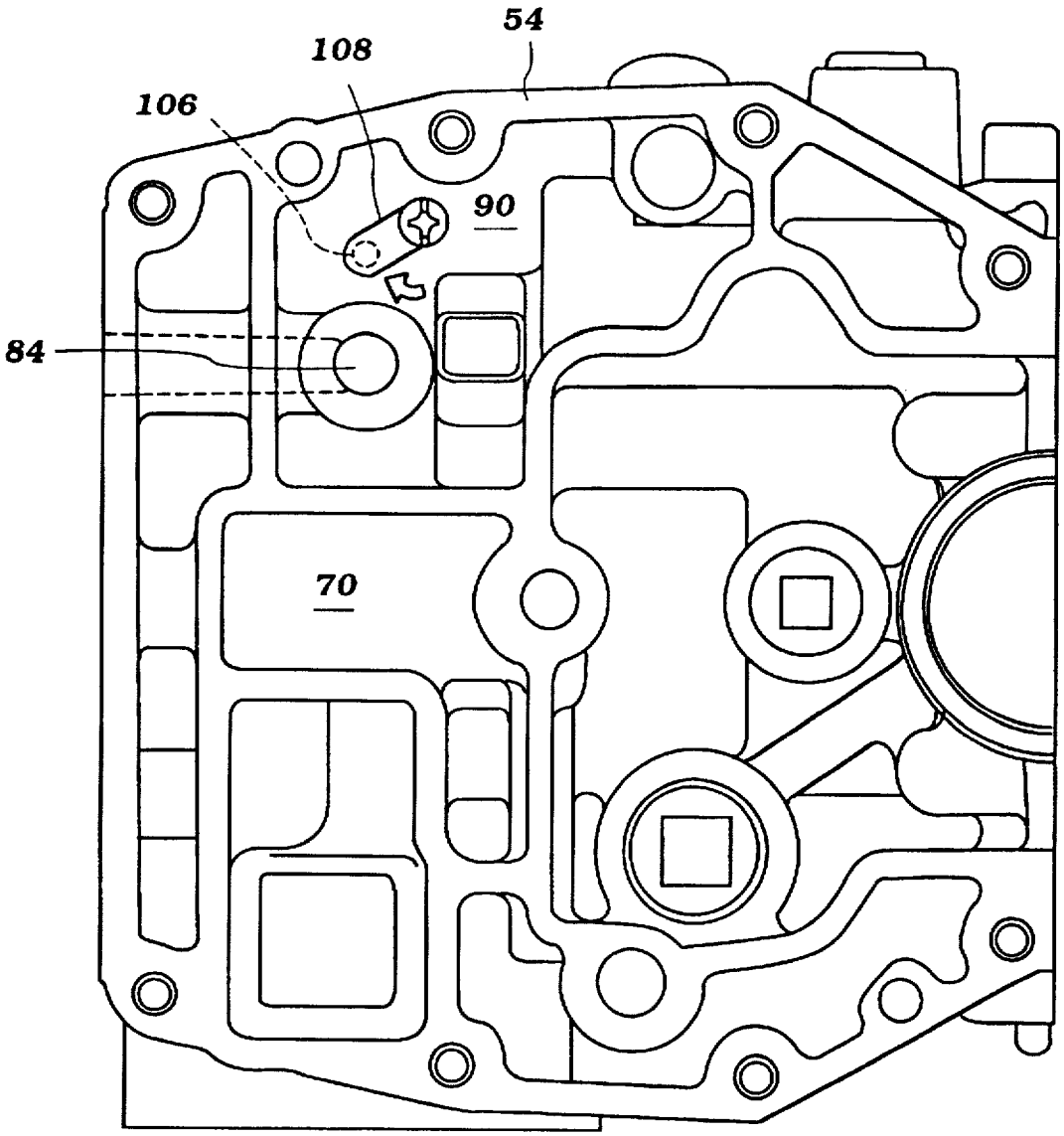
FIG. 6 is a bottom plan view of the cylinder block of FIG. 3.

As seen in FIG. 6, the drain 106 opens on the bottom of the cylinder block 54 at a location adjacent to the pick-up conduit 84 that delivers lubricant to the pump 86 of the lubrication system. Thus, the pick-up line 82 extends through the same passage 92 within the exhaust guide 48 through which the lubricant returns to the reservoir 74. This arrangement reduces the engine's footprint and the size of the exhaust guide 48, for additional material and cost savings.

Figure 5:
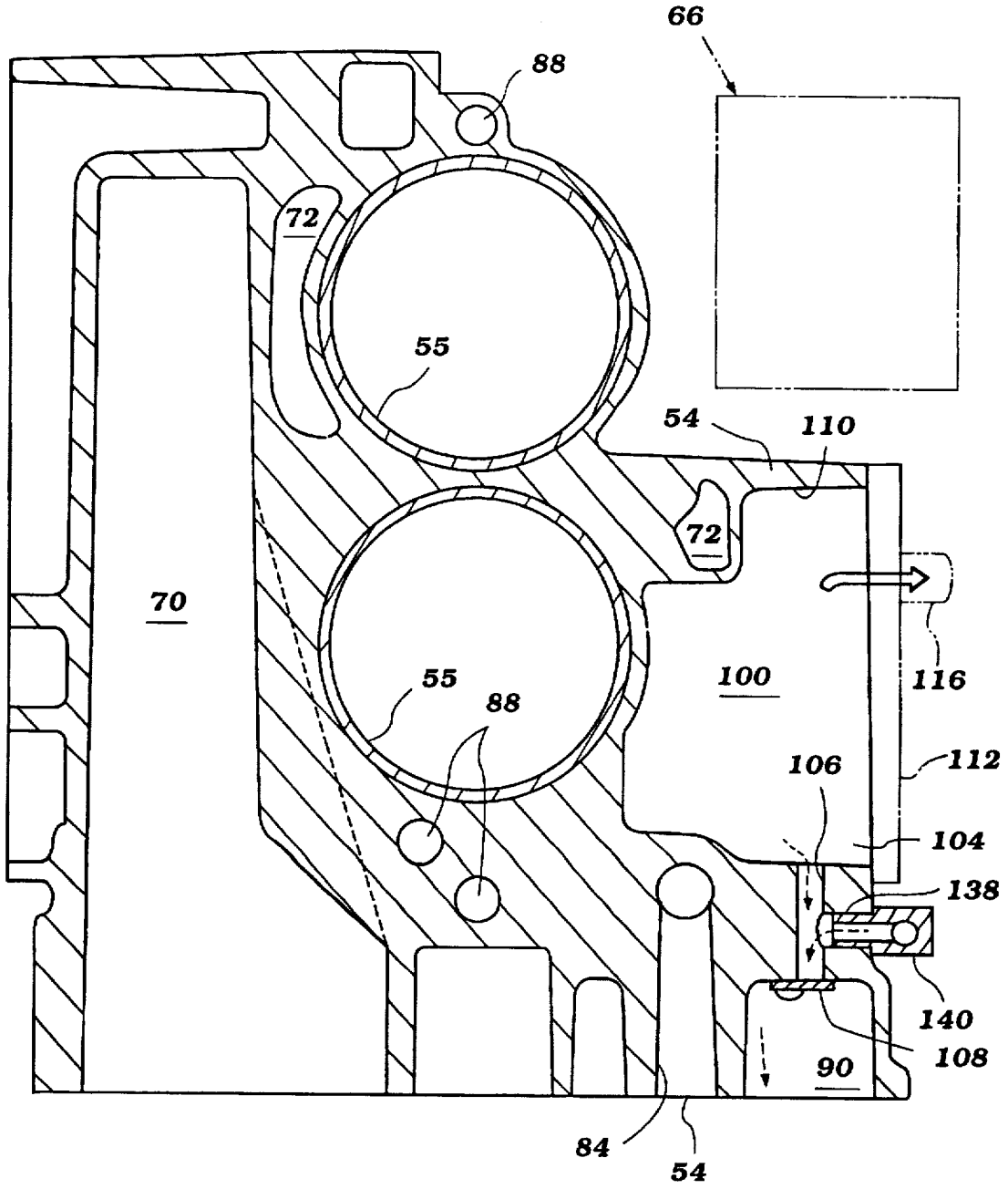
FIG. 5 is a cross-sectional view of the cylinder block of FIG. 3 taken along line 5—5.

In the illustrated embodiment, as understood from FIGS. 4 and 5, the breather chamber 100 is defined within a recess 110 integrally cast into the side of the cylinder block 54. As noted above, by positioning the breather chamber 100 of the lubricant separator 94 at this location—on the side of the cylinder block 54 beneath the charge former 66—the size of the breather chamber 100 can be significant increased over prior designs, without increasing the girth of the engine 14. In fact, the girth of the engine 14 is reduces when compared with many conventional engine layouts that locate the breather chamber 100 on the exterior of the cylinder head cover 62.

A cover plate 112 is attached to the cylinder block 54 and covers the recess 110. The cover 112 thus completes the breather chamber 100 which is defined between the recess 110 and the cover 112. Any of a variety of conventional means can be used to secure the cover 112 to cylinder block 54; however, it is desirably that removable fasteners (e.g., bolts) be used in order to remove the cover 112 for servicing of the valve or for cleansing of the orifice 98, the breather chamber 100, or the drain passage 106. As understood from FIG. 3, the bolts (not shown) can threadingly engage the holes 114 defined around the periphery of the breather chamber 100.

The blow-by gases egress from the breather chamber 100 through an effluent port 116 formed at the upper end of the breather chamber 100. In the illustrated embodiment, the effluent port 116 is formed on the cover plate 112. The effluent port 116 desirably lies on the outer side of the breather chamber 100 and at a point above the orifice 98. In this manner, blow-by gases entering the breather chamber 100 must change direction twice within the breather chamber 100 in order to flow into the effluent port 116. These changes in flow direction of the gases within the breather chamber 100 help separate further the lubricant from the blow-by gases.

The ventilation system also desirably includes a second lubricant separator 118 that receives the blow-by gases vented from the breather chamber 100 of the first lubricant separator 94. For this purpose, as seen in FIG. 2, a discharge conduit 120 extends between the effluent port 116 of the breather chamber 100 to an inlet port 122 of the second lubricant separator 118.

Figure 7:
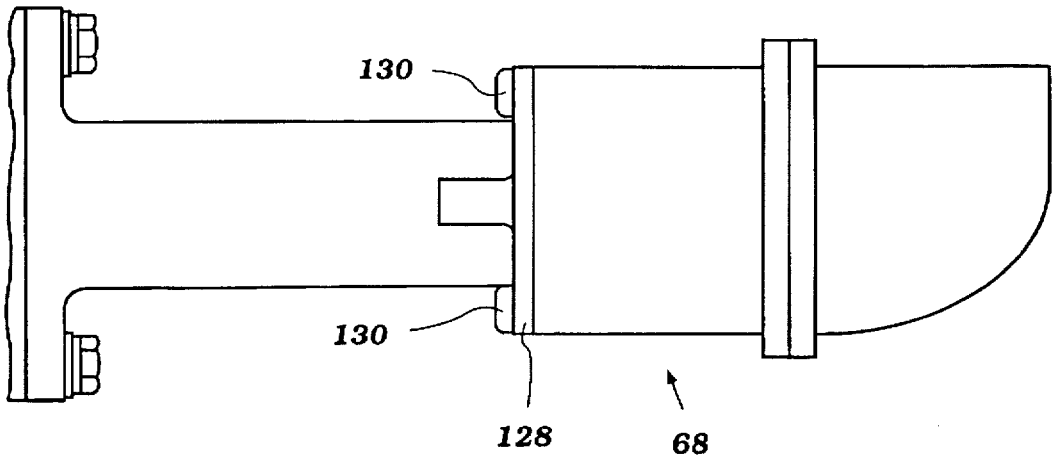
FIG. 7 is an isolated top plan view of an air intake device of the engine of FIG. 2.
Figure 8:
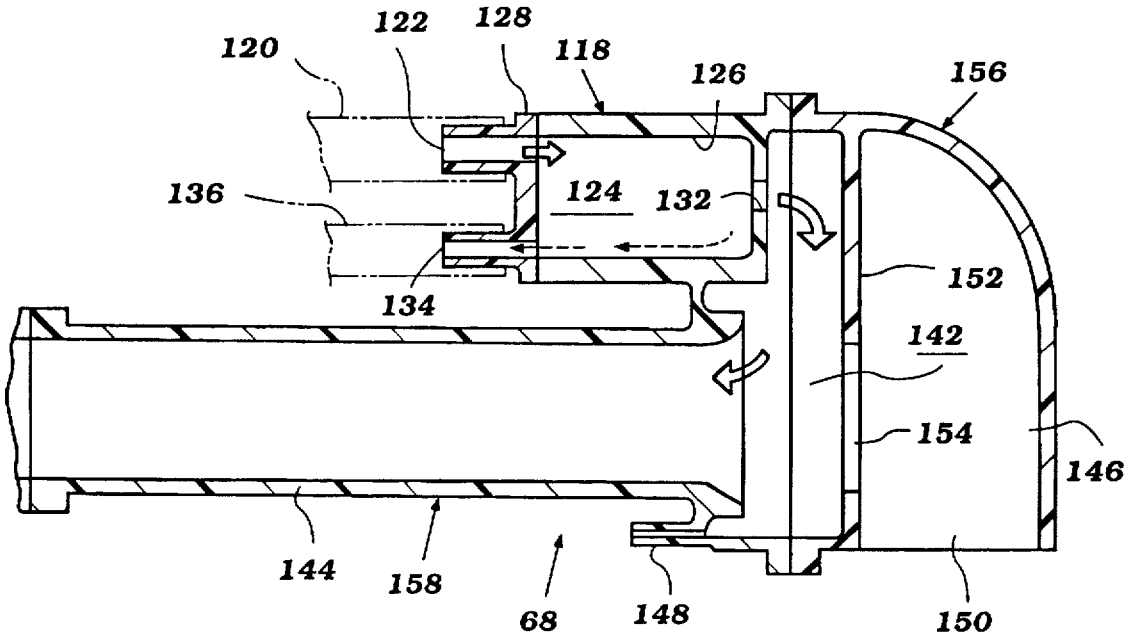
FIG. 8 is a cross-sectional side view of the intake silencer of FIG. 7.
Figure 9:
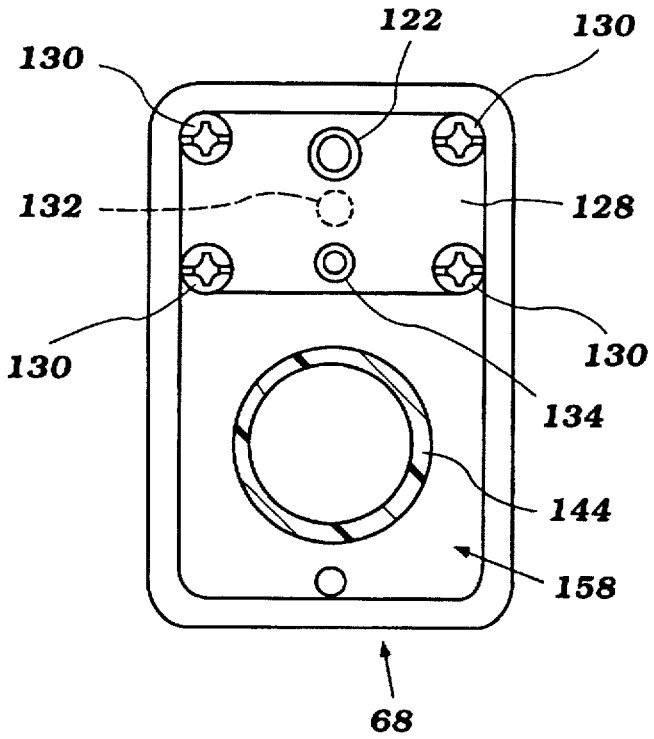
FIG. 9 is a cross-sectional view of the intake silencer of FIG. 7 taken along line 9—9.

With reference to FIGS. 7–9, the second lubricant separator 118 desirably is formed as an integral part of the air intake device 68. The second lubricant separator 118 includes a breather chamber 124 defined between a recess 126 and a cover plate 128. The recess 126 is integrally molded with at least a portion of the air intake device 68. Conventional fasteners 130 secure the cover 128 to the recess housing to close the breather chamber 124.

The breather chamber 124 has a larger cross-sectional flow area than that of the inlet port 122. The blow-by gases consequently expand rapidly within the breather chamber 124 to separate further lubricant from the blow-by gases.

An orifice 132 is formed at the opposite end of the breather chamber 124. The cross-sectional flow area is several times smaller than the cross-sectional flow area of the breather chamber 124. As a result, the blow-by gases must compress again to flow through the orifice 132. This again tends to cause any remaining lubricant vapor to drop out of the blow-by gas.

The separated lubricant drains from the second lubricant separator 118 through a drain port 134 located on the lower side of the breather passage 124. A drainage conduit 136 connects to the drain port 134 and delivers the separated lubricant back to the lubricant return passageway 90. In the illustrated embodiment, as best seen in FIGS. 2 and 5, the drainage conduit 136 is connected to a port 138 formed on the side of the cylinder block 54 beneath the cover plate 112. A fitting 140 desirably connects the end of the drain conduit 136 to the port 138. The port 138 in turn opens into the drain passage 106 that also communicates with the breather chamber 100 of the first lubricant separator 94. The lubricant from the drainage conduit 136 thus returns to the lubricant reservoir 74 together with the lubricant separated by the first lubricant separator 94.

With reference back to FIGS. 7–9, the blow-by gases within the breather chamber 124 of the second lubricant separator 118 are introduced into an intake air stream flowing through the intake device 68. The orifice 132 opens into an expansion chamber 142 formed within the intake device 68. The expansion chamber 142 is positioned between an induction pipe 144 that leads to the charge former 66 and a plenum chamber 146 into which air initially flows.

As best seen in FIG. 8, a drain port 148 is formed at the bottom of the expansion chamber 142. The drain port 142 provides drainage for any water that may be separated from the blow-by gases or ambient air as these gases enter the expansion chamber 142. Although not illustrated, a drainage tube is connected to the drain port 148 to discharge the separated water outside the protective cowling assembly 16.

In the illustrated embodiment, the plenum chamber 146 includes a downwardly-facing opening 150 through which air is drawn. A wall 152 separates the plenum chamber 146 from the expansion chamber 142. An opening 154 in the wall 152 places the plenum chamber 146 in communication with the expansion chamber 142 such that air within the plenum chamber 146 flows into the expansion chamber 142. The blow-by gas diffuses in the expansion chamber 142 as it mixes with the ambient air drawing into the expansion chamber 142 through the opening 154 in the wall 152. The expansion chamber 142 desirably has a size sufficiently large to foster diffusion of the blow-by gases.

The mixture of the blow-by gas and the ambient air flows from the expansion chamber 142 into the induction pipe 144. The induction pipe 144 delivers this mixture to the charge former 66. The charge former 66 forms an fuel/air charge with the mixture which is delivered to the combustion chambers of the engine 14 in the manner described above.

The plenum chamber 146, the wall 152 and a portion of the expansion chamber 142 desirably are integrally cast in one piece 156 and the induction pipe 144, a portion of the expansion chamber 142 and the recess 126 that forms the breather chamber 100 desirably are integrally cast in another piece 158. These pieces 156, 158 are assembled together by any of a variety of conventional means, such as, for example, by welding or with the use of fasteners (e.g., bolts).

The present ventilation system thus effectively removes lubricant from blow-by gases vented from the lubrication system before reintroducing these gases into the induction system. The redundancy in the ventilation system which provided by the lubricant separators arranged in series increases lubricant separation from the blow-by gases in order to reduce hydrocarbon emissions. The present ventilation system also accomplishes these advantages with components that are integrated into the various other component of the engine at unobtrusive locations. The lubricant separators of the ventilation system do not protrude from any engine component, and thus do not increase the girth of the engine. As a result, the size of the engine, as well as the size and weight of the cowling can be reduced.

Although this invention has been described in terms of a certain preferred embodiment, other embodiments apparent to those of ordinary skill in the art are also within the scope of this invention. Accordingly, the scope of the invention is intended to be defined only by the claims that follow.

What is claimed is:

1. An internal combustion engine comprising a crankcase formed between a cylinder block and a crankcase member, a lubrication system including a lubricant reservoir, the lubrication system being configured to deliver lubricant from the lubricant reservoir to at least the crankcase, and a ventilation system in communication with the lubricant system, the ventilation system including a lubricant separator disposed on one side of the cylinder block, said lubricant separator including a breather chamber, a first passage extending between the lubrication system and the breather chamber, and a second passage extending between the breather chamber and the lubrication system, at least portions of both the first and second passages being integrally formed with the cylinder block.

2. An engine as in claim 1, wherein said lubrication system includes an lubricant return passageway extending between the crankcase and a lubricant reservoir.

3. An engine as in claim 2, wherein the lubricant separator communicates with the lubricant return passageway through said first passage and communicates with the lubricant reservoir through said second passage.

4. An engine as in claim 3, wherein the second passage is positioned below the breather chamber and above the lubricant reservoir.

5. An engine as in claim 4, wherein a valve operates between the breather chamber and the lubricant reservoir, the valve being arranged to permit an effluent flow of fluid from the breather chamber toward the reservoir, and to inhibit an influent flow of fluid through the second passage into the breather chamber.

6. An engine as in claim 5, wherein a second valve operates between the first passage and the breather chamber, said second valve being arranged to permit an ingress of fluid into the breather chamber from the first passage, and to inhibit an egress of fluid from the breather chamber into the first passage.

7. An engine as in claim 4, wherein the first passage communicates with the breather chamber at a point above an opening to the second passage.

8. An engine as in claim 3, wherein the breather chamber has an effluent port located at a level on the lubricant separator above an opening through which the first passage opens into the breather chamber.

9. An engine as in claim 8, wherein the effluent port is arranged relative to the opening of the first passage such that fluid flow for the first passage into the breather chamber changes flow direction twice within the breather chamber before flowing through the effluent port.

10. An engine as in claim 8, wherein an opening to the second passage within the breather chamber is positioned below the opening of the first passage within the breather chamber.

11. An engine as in claim 3, wherein the lubricant separator includes an orifice which places the first passage in communication with a breather chamber of the lubricant separator.

12. An engine as in claim 11, wherein a flow volume through the orifice is smaller than a volume of the breather chamber.

13. An engine as in claim 2, wherein the lubricant reservoir is formed within a pan positioned beneath the cylinder block.

14. An engine as in claim 2, wherein the lubricant return passageway is formed within the cylinder block.

15. An engine as in claim 1, wherein at least a portion of the breather chamber is integrally formed with the cylinder block.

16. An engine as in claim 15, wherein the lubricant separator includes an orifice which extends between the first passage and the breather chamber, the first passage extends between a passageway formed within the cylinder block and a recess formed on the side of cylinder block, and the breather chamber is formed between the recess and a cover that is attached to the side of the cylinder block in a position covering the recess.

17. An engine as in claim 1 additionally comprising an induction system including an air intake device which delivers air to at least one charge former, and the charge former communicating with at least one intake passage formed within the cylinder block.

18. An engine as in claim 17, wherein the lubricant separator is located on the side of the cylinder block below the charge former.

19. An engine as in claim 17, wherein said ventilation system additionally comprises a secondary lubricant separator arranged in series with the lubricant separator on the side of the cylinder block such that ventilation gases passed through the lubricant separator subsequently pass through the secondary lubricant separator.

20. An engine as in claim 19, wherein said secondary lubricant separator is integrally formed with the air intake device.

21. An engine as in claim 19, wherein the secondary lubricant separator includes a lubricant drain which communicates with a drain passage that also communicates with the lubricant separator on the side of the cylinder block.

22. An internal combustion engine comprising at least one variable-volume compression chamber communicating with at least one intake passage, an induction system including an air intake device that supplies air to a charge former, said charge former delivering a fuel/air charge to the intake passage, a lubrication system which circulates lubricant through the engine, and a ventilation system including a first lubricant separator that communicates with the lubrication system so as to vent blow-by gas from the lubrication system, and a second lubricant separator that receives a flow of blow-by gas from the first lubricant separator, the second lubricant separator communicating with the air intake device to deliver at least a portion of the blow-by gas to the intake passage.

23. An engine as in claim 22, wherein the first and second lubricant separators each include lubricant drains that communicate with a lubricant reservoir located at a lower end of the engine.

24. An engine as in claim 22, wherein the second lubricant separator is integrally formed with the air intake device.

25. An engine as in claim 24, wherein the intake device includes an expansion chamber and the lubricant separator includes a breather chamber with an orifice placing the breather chamber in communication with the expansion chamber.

26. An engine as in claim 25, wherein the expansion chamber is positioned between a plenum chamber and an induction pipe of the intake device.

27. An engine as in claim 22 additionally comprising a cylinder block including at least one cylinder, at least a portion of the cylinder forming at least part of the variable-volume compression chamber, and said first lubricant separator being at least partially integrally formed with the cylinder block.

28. An engine as in claim 27, wherein said first lubricant separator is located on the side of the cylinder block.

* * * * *